US005714172A

United States Patent [19]

Schönberg

[11] Patent Number: 5,714,172

[45] Date of Patent: Feb. 3, 1998

[54] SPINNING DEVICE WITH MOVABLE JOINT

[75] Inventor: Anton Schönberg, Regau, Austria

[73] Assignee: Lenzing Aktiengesellschaft, Lenzing, Austria

[21] Appl. No.: 581,540

[22] PCT Filed: May 22, 1995

[86] PCT No.: PCT/AT95/00097

§ 371 Date: Jan. 5, 1996

§ 102(e) Date: Jan. 5, 1996

[87] PCT Pub. No.: WO95/33087

PCT Pub. Date: Dec. 7, 1995

[30] Foreign Application Priority Data

May 26, 1994 [AT] Austria ..... A1071/94

[51] Int. Cl.[6] ..... B29C 35/06

[52] U.S. Cl. ..... 425/67; 425/69; 425/71; 425/72.2; 425/192.5; 264/188

[58] Field of Search ..... 425/67, 68, 69, 425/71, 72.2, 190, 185; 264/391, 178 F

[56] References Cited

U.S. PATENT DOCUMENTS

| | | | |
|---|---|---|---|
| 2,198,448 | 4/1940 | Allquist . | |
| 2,243,116 | 5/1941 | Ostermann | 425/69 |
| 2,533,103 | 12/1950 | Givens et al. | 425/68 |
| 2,586,970 | 2/1952 | McDermott | 425/69 |
| 2,611,925 | 9/1952 | Merion et al. | 425/68 |
| 2,624,070 | 1/1953 | McDermott . | |
| 2,803,851 | 8/1957 | Bavnlich et al. | 425/69 |
| 2,920,346 | 1/1960 | Yori | 425/68 |

FOREIGN PATENT DOCUMENTS 836538 4/1952 Germany .

OTHER PUBLICATIONS

K. Götze, "Man Made Fibres Using the Viscose Process" vol. 2, 3rd Edition, Springer Publications, Berlin/Heidelberg/New York (1967) pp. 847–853.

*Primary Examiner*—Jay H. Woo
*Assistant Examiner*—Iurie A. Schwartz
*Attorney, Agent, or Firm*—Brumbaugh, Graves, Donohue & Raymond

[57] ABSTRACT

A spinning device for the production of man-made fibers, in particular of cellulose regenerated fibers, including at least one spinning pump, at least one feed pipe line, at least one spinneret and a bath-like container for the precipitation bath whereby the feed pipe lines can be swivelled around at least one joint at any one time which is characterized in that the joint is movable in substantially horizontal and vertical direction. In one embodiment of the device the joint can be swivelled around one pivot respectively. With the device according to this invention, it is possible to simply swivel the spinnerets out of a deeper container which is required to enable a longer immersion path of the fibers.

5 Claims, 1 Drawing Sheet

SPINNING DEVICE WITH MOVABLE JOINT

BACKGROUND OF THE INVENTION

The invention refers to a spinning device for the production of man-made fibres, particularly cellulose regenerated fibres. Well-known spinning devices, for the production of cellulose regenerated fibres for example, operate on the principle that a viscous spinning solution or spinning mass e.g. viscose is pressed by means of pumps through a spinneret into an aqueous precipitation bath containing chemical additives. A filament of regenerated cellulose is thereby formed as a result of viscose decomposition which is drawn off via rollers or something similar whereby stretching of the filaments generally takes place in the precipitation bath.

An example of a spinning device built in the traditional fashion is illustrated in "Man-Made Fibres Using the Viscose Process" by K. GÖTZE, 3rd Edition, Volume 2, Springer Publications Berlin/Heidelberg/New York (1967) on p. 850. The device is made of a bath-like container on which spinning pumps are arranged in the longitudinal direction which transport the spinning solution (viscose) via feed pipe lines to a spinneret. The bath-like container contains the precipitation bath into which the spinneret is dipped whereby the openings of the spinneret are aligned so that the fibres emerging from the spinneret emerge in a substantially vertical direction. The feed pipe lines for the spinning solutions are pivoted around joints which means that the spinneret can be swivelled out of the container during maintenance work, or when disconnecting the line.

The development of new types of fibres with special properties has meant that numerous parameters in the spinning process for the production of cellulose regenerated fibres have been changed. Amongst these parameters one can for example count the retention time of the filament in the precipitation bath which is adjusted by the take-up speed, and in particular by the immersion path of the filaments in the precipitation bath. In this way, an effort was made in particular to extend the immersion path.

The immersion path can be extended if, for example, the emerging filament is not drawn off substantially vertically but rather emerges from the spinneret in more of a horizontal direction by using a flatter container and is drawn off horizontally thereby being immersed in the precipitation bath for a longer distance in this container.

By this measure the immersion path is extended, however, the use of a flat container and the drawing-off of the filament in the horizontal direction on the one hand demands a considerably greater amount of space and on the other hand, the filament has to be led around rollers, or a similar device, which has a negative impact on the fibre properties.

A second possibility to extend the immersion path is to design the container with the precipitation bath deeper with respect to a drawing-off in vertical direction. Until now, this could only be achieved to the extent that it was still possible to swivel the spinneret out from the deeper container according to the length of the feed pipe line. Since in order to effectively be able to bring the spinneret into the deep parts of the container, which is necessary to achieve a longer immersion path, it is also necessary to correspondingly extend the feed pipe line. However, it is not possible to swivel the spinneret out of the container once a feed pipe line of a certain length is used. This can only be done once apparatus parts obstructing the swivelling process have been removed.

SUMMARY OF THE INVENTION

It is an object of the present invention to arrange a spinning device on the basis of the principle described above so as to make it possible to provide a deeper container for the precipitation bath so that the immersion path can be prolonged and, at the same time, the spinneret can be easily swivelled out of the container.

According to this invention this object is reached by means of a spinning device for the manufacture of man-made fibres, and in particular cellulose regenerated fibres, comprising at least one spinning pump, at least one feed pipe line, at least one spinneret and one bath-like container for the precipitation bath whereby the at least one feed pipe line can be swivelled around one joint respectively, which is characterised in that the joint is arranged movable in substantially vertical and horizontal direction.

The arrangement according to this invention that the joints, around which the feed pipe lines for the spinning solution can be swivelled, are also movable, can very simply produce a considerable advantage when handling the spinning device. The feed pipe lines can be easily swivelled out even of a deep container which means that maintenance work, such as for example the exchange of the spinneret or a similar operation, can be performed more swiftly and easily and yet all the advantages of a long immersion path of the filament in the precipitation bath are upheld.

One particularly effective embodiment of the spinning device according to the invention is characterized in that the joints can be swivelled around one pivot, respectively. This particular arrangement makes it especially easy to swivel the feed pipe lines out of the container. The pivot, around which the joints are stored, can for example be located on the longitudinal wall of the container, however, from the point of view of construction, many other embodiments of the invention are possible.

BRIEF DESCRIPTION OF THE DRAWINGS

A preferred embodiment of the invention is illustrated in the appended drawings, in which.

DETAILED DESCRIPTION OF THE INVENTION

Figure 1:
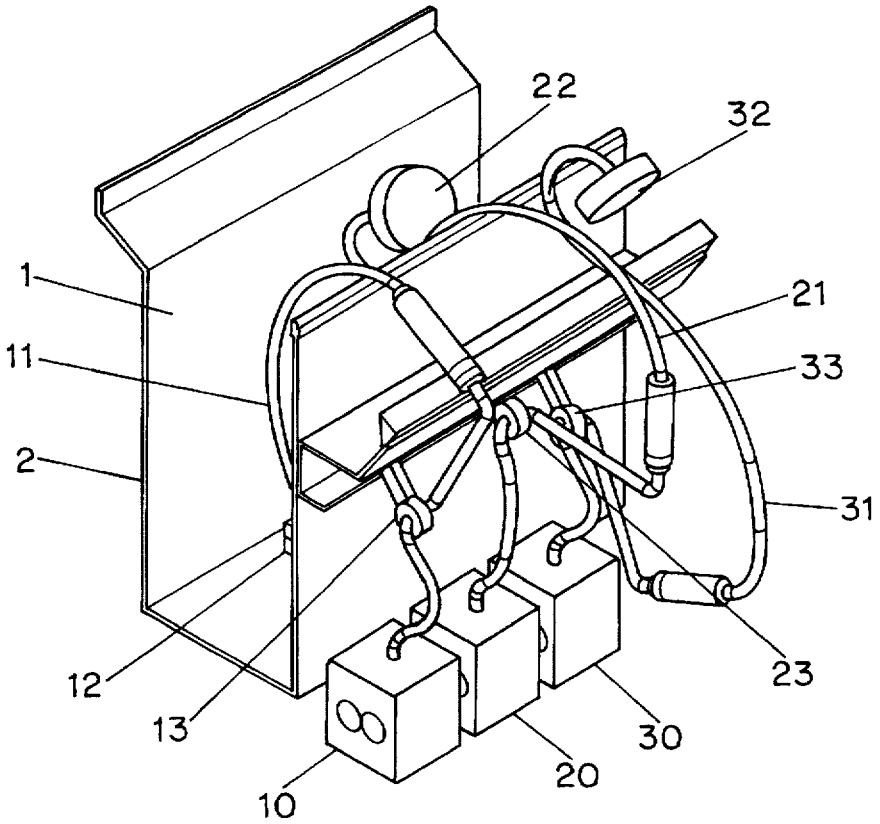
FIG. 1 is an oblique view of the spinning device of the invention.
Figure 2:
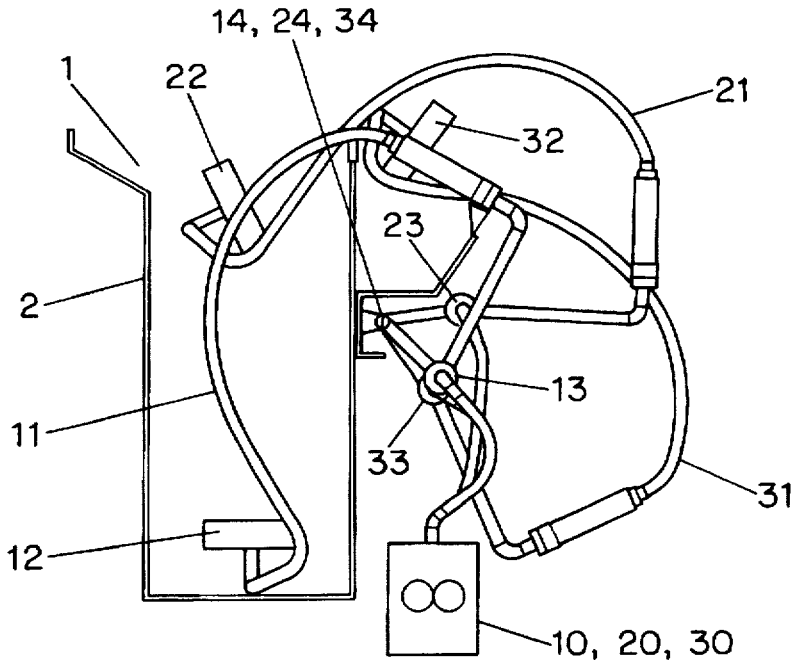
FIG. 2 is a side view of the spinning device of the invention.

One favoured embodiment of the invention is described as an illustration in FIGS. 1 and 2 whereby FIG. 1 displays a look at an angle of a spinning device according to this invention and FIG. 2 provides a side view.

It should be noted that the embodiment of the invention shown in FIGS. 1 and 2 represents one of many possible forms of the spinning device according to this invention.

FIG. 1 shows the nature of a spinning device (1) according to this invention. It comprises a container 2 for the precipitation bath (not shown), for example three spinning pumps 10, 20 and 30, which provide the feed pipe lines 11, 21 and 31 with spinning solution. Spinnerets 12, 22 and 32 are located at the end of each feed pipe line from which the filaments (not illustrated) emerge into the precipitation bath. The feed pipe lines can be swivelled around one joint 13, 23 and 33 respectively and are bent to alleviate the swivelling out from the container. The bend, however, is not sufficient to permit full swivelling-out with respect to a deeper container like that shown in FIG. 2.

For this reason, according to the invention it is provided that the joints themselves are arranged movable in the vertical and horizontal direction and that, in the case of the embodiments given preference in FIGS. 1 and 2, around one pivot 14, 24 and 34 (can only be seen in FIG. 2) respectively, which is attached to the longitudinal wall of container 2.

The principle of the invention will now be illustrated substantially by the different positions of the feed pipe lines 11, 21 and 31. Feed pipe line 11 together with the necessary spinneret 12 is in the position adopted when the spinning device is in operation i.e. when spinning. The spinneret is located, as can be seen from FIG. 2, right at the bottom of container 2 which guarantees a long immersion path of the emerging filaments.

If the spinneret now has to be swivelled out of the container due to an interruption in the spinning operation for example due to maintenance work, the feed pipe line will first of all be slightly raised, which is illustrated in the figures with respect to feed pipe line 21 including spinneret 22. The joint 23 belonging to the feed pipe line 21 is swung upwards round pivot 24 by this movement.

In a second step it is now simple to swivel the feed pipe line completely out of the container as is illustrated with respect to feed pipe line 31 with the necessary spinneret 32. The joint 33 belonging to feed pipe line 31 is in turn swung downwards.

During the entire swivel operation no other apparatus part is touched by the feed pipe line or by the spinneret so that this process can be completed very easily. Of course, in reality, the swivel operation represents a continuous process. The process was broken down into steps to better illustrate the invention on the basis of FIGS. 1 and 2.

It is quite clear that without the arrangement of the itself movable joint 13, 23, 33 according to this invention, it would not be possible to swivel the feed pipe lines out of a deep container like for example the one shown in the figures. The invention, therefore, incorporates a number of process simplifications when producing spinning filaments with modified fibre properties due to the prolonged immersion path.

I claim:

1. A spinning device for the production of man-made fibers, in particular cellulose regenerated fibres, comprising at least one spinning pump, at least one feed pipe line, at least one spinneret, a container for a precipitation bath whereby the feed pipe line can be swivelled around at least one joint wherein the joint is arranged movable in substantially horizontal and vertical direction.

2. Spinning device according to claim 1 wherein the joint can be swivelled around one pivot.

3. Spinning device according to claim 2 wherein the pivot is located on a longitudinal wall of the container.

4. Spinning device according to claim 1 having a plurality of feed pipe lines, a plurality of joints and a plurality of pivots, wherein each feed pipe line can be swiveled around a respective joint and wherein each joint can be swiveled around a respective pivot.

5. Spinning device according to claim 4, wherein each pivot is located on a longitudinal wall of the container.

* * * * *